United States Patent [19]

Agarwal

[11] Patent Number: 4,922,305

[45] Date of Patent: May 1, 1990

[54] APPARATUS FOR RELEASE OF DEBRIS TRAPPED BETWEEN A BLADE AND CHARGE RETENTIVE SURFACE

[75] Inventor: Vinod K. Agarwal, Webster, N.Y.

[73] Assignee: Xerox Corporation, Stamford, Conn.

[21] Appl. No.: 407,182

[22] Filed: Sep. 14, 1989

[51] Int. Cl.[5] ..... G03G 21/00

[52] U.S. Cl. ..... 355/299; 355/212; 355/296

[58] Field of Search ..... 355/299, 296, 212, 298, 355/270, 269

[56] References Cited

U.S. PATENT DOCUMENTS

| | | | |
|---|---|---|---|
| 3,785,730 | 1/1974 | Weber et al. | 355/16 |
| 3,843,407 | 10/1974 | Thorp | 134/6 |
| 3,912,390 | 10/1975 | van Herten | 355/14 |
| 3,940,282 | 2/1976 | Hwa | 355/299 X |
| 4,577,953 | 3/1986 | Narukawa | 355/3 BE |
| 4,657,369 | 4/1987 | Takeuchi | 355/3 BE |
| 4,690,544 | 9/1987 | Forbes, II et al. | 355/15 |
| 4,788,572 | 11/1988 | Slayton et al. | 355/326 X |

*Primary Examiner*—Fred L. Braun
*Assistant Examiner*—Thu Dang
*Attorney, Agent, or Firm*—Mark Costello

[57] ABSTRACT

In an electrophotographic device of the type including a belt-type charge retentive member, driven along an endless path through a series of image processing stations by a frictionally engaging driving member, including a blade cleaning station for removing residual toner and debris from the member after transfer of a toner image to a final substrate and an arrangement for controlling the driving member to selectively drive the charge retentive member in either direction along the endless path, so that the member may be occasionally back tracked to clear debris accumulating at the blade cleaner, the back tracking movement is controlled by provision of at least first and second sensor detectable indicia on the charge retentive member, spaced therealong at an interval equivalent to the desired back tracking distance. A sensor suitable for detecting the detectable indicia on the charge retentive member is provided, to produce and direct detection signals to a machine controller controlling the back tracking operation of the device in accordance with detection of the indicia. Alternatively, successive detections of the same indicia during normal operation may be used as a measurement of average belt velocity.

12 Claims, 4 Drawing Sheets

APPARATUS FOR RELEASE OF DEBRIS TRAPPED BETWEEN A BLADE AND CHARGE RETENTIVE SURFACE

This invention relates to reproduction apparatus, and more particularly, to an arrangement for release of debris trapped between a cleaning blade and a charge retentive surface.

INCORPORATION BY REFERENCE

US-A 4,690,544 to Forbers, II et al. is incorporated by reference herein for the purpose of background information on the described cleaning arrangement.

BACKGROUND OF THE INVENTION

In electrophotographic applications such as xerography, a charge retentive surface is electrostatically charged and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a tone image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. The process is well known and useful for light lens copying from an original and printing applications from electronically generated or stored originals, where a charged surface may be imagewise discharged in a variety of ways. Ion projection devices where a charge is imagewise deposited on a charge retentive substrate operate similarly.

Although a preponderance of the toner forming the image is transferred to the paper during the transfer step, some toner invariably remains on the charge retentive surface, it being held thereto by relatively high electrostatic and/or mechanical forces. Additionally, paper fibers, Kaolin and other debris have a tendency to be attracted to the charge retentive surface. It is essential for optimum operation that the toner remaining on the surface be cleaned thoroughly therefrom. Blade cleaning is a highly desirable method for removal of residual toner and debris (hereinafter, collectively referred to as "debris") from a charge retentive surface, because it provides a simple, inexpensive structure compared to the various fiber or magnetic brush cleaners that are well known in the dry electrophotography art. In a typical application, a relatively thin elastomeric cleaning blade member is provided and supported adjacent the charge retentive surface, transverse to the direction of relative movement, with a blade edge chiseling or wiping toner from the surface. Subsequent to release of debris from the surface, the released debris accumulating adjacent the cleaning blade is transported away from the cleaning blade area by a debris transport arrangement or gravity.

It has been noted that after some number of copies are made, paper fibers and other debris tend to become entrapped underneath the blade, between the blade and the charge retentive surface. Unless the debris is dislodged, a copy quality defect tends to occur, characterized by streaks on the copy. Usually, a service call is required to correct the problem.

US-A 3,843,407 to Thorp describes a method of clearing entrapped debris from between the blade and the charge retentive surface by driving a rigid drum photoreceptor in a reverse movement, or back tracking the photoreceptor, to release entrapped debris. To accomplish the back tracking movement, the motor driving the drum is reversed and the reverse motion is transmitted to the drum through a drive shaft and sprocket/-chain drive. Generally, back tracking occurs over a selected period of time chosen to given an adequate clearing of debris.

In an electrophotographic device having a flexible belt-type charge retentive member, the driving motor is frictionally coupled to the belt through a driving member, to drive the belt along an endless path typically defined by a set of rolls, one of which is usually a driving member. In such a device there is a natural tendency of the belt to slip. Such belts also commonly have a belt seam, which, if an image is placed over the seam, will cause a copy quality defect. To control operation of the device with respect to the belt, and to assure that imaging does not occur on a belt seam, a hole or indicia is commonly provided on the belt at a fixed position relative to the seam. The hole or indicia is detected, and the imaging operation is started in accordance with the detected belt position.

Typically, to control the amount of back tracking, a drive member would be driven to drive the belt in a reverse direction, with respect to the usual direction, for a selected period of time. However, because slip is likely to occur in that situation, the amount of back tracking is not accurately predictable. Accordingly, subsequent to the back tracking operation, the machine must reacquire the belt position. If the back tracking operation is used relatively frequently, the user may note the delay in device operation required by the machine search for the sensor detectable indicia. Additionally, the slip problem becomes worse as the belt and machine age, so that distance traveled over a short period of time becomes unpredictable. Additionally, the back tracking distance has design limitations. The belt should back track only a selected distance, and not overshoot or exceed that distance, determined by such factors such as the the cleaning region size. However, because of the uncertainty of the back tracking distance, it is not always possible to remain within that distance.

US-A 3,912,390 to van Herten discloses a control circuit for a electrostatic copying machine which regulates the drive system of a photoreceptor belt based on a series of pulsed feedback signals received from an optical sensor which detects the passage of marks notched into a photoreceptor belt. US-A 3,785,730 to Weber et al. discloses a solid state circuit device which controls the movement of a photoreceptor belt by varying the position of image-forming surfaces during successive copy runs. Photodetecting sensors sense the passage of and issue position control signals corresponding to alignment marks on the surface of a photoreceptor belt, to trace out a length of belt defined between two successive marks. US-A 4,577,953 to Narukawa discloses an automatic control system for an electrostatic copying machine comprising a photosensitive sensor which detects cutouts, punched into both sides of a belt-like photosensitive member, and issues signals to a controller based on these cutouts to control the copying process. US-A 4,657,369 to Takeuchi discloses a "smart" electrostatic copying machine comprising an internal computer system which regulates the movement of an endless photoconductive belt based on signals received by a photosensing device which coordinates the position of a photoconductive belt based on the passage and detection of a single notch punched into the belt, as sensed by a photosensor. The notch placed at a predetermined distance from the belt seam, allows the machine belt drive system to avoid placing an image onto the belt seam during the copying process. The references cited herein are all incorporated by reference for their teachings.

SUMMARY OF THE INVENTION

In accordance with the invention there is provided an arrangement for improved control of belt slip in a belt-type charge retentive member electrophotographic device, wherein the belt-type charge retentive member is driven by a drive arrangement in frictional engagement therewith.

In accordance with one aspect of the invention, an electrophotographic device of the type including a belt-type charge retentive member, driven along an endless path through a series of image processing stations by a frictionally engaging driving member, including a blade cleaning station for removing residual toner and debris from the member after transfer of a toner image to a final substrate and an arrangement for controlling the driving member to selectively drive the charge retentive member in either direction along the endless path, so that the member may be occasionally back tracked to clear debris accumulating at the blade cleaner, the back tracking movement is controlled by provision of at least first and second sensor detectable indicia on the charge retentive member, spaced therealong at an interval equivalent to the desired back tracking distance. A sensor suitable for detecting the detectable indicia on the charge retentive member is provided, to produce and direct detection signals to a machine controller controlling the back tracking operation of the device in accordance with detection of the indicia.

In accordance with another aspect of the invention, a method is provided for controlling a back tracking function in an imaging device having a belt-type charge retentive surface moving along an endless path past a plurality of processing stations with a frictionally engaging drive arrangement; a motor coupled to the drive arrangement providing a motive force to move the charge retentive surface along the endless path in either of forward or reverse directions; a latent image forming station; a developing station developing the latent image with toner; a transfer station for transferring the developed latent image to a substrate; and a cleaning station including a cleaning blade for releasing residual toner and debris from the charge retentive surface after transfer; the back tracking function operative to release toner and debris entrapped between the the cleaning blade and the charge retentive surface including the steps of: providing at least first and second sensor detectable indicia on the charge retentive surface, spaced at a selected interval, and a complementary sensor arrangement at a fixed location with respect to the endless path, to detect the indicia as they pass thereby; moving the charge retentive surface along the endless path in a first direction; detecting the passage of the first and second sensor detectable indicia on the charge retentive surface upon detection of the second sensor detectable indicia, reversing the motive force provided to the drive arrangement to move the charge retentive surface in a second direction, opposite said first direction; detecting the first sensor detectable indicia; upon detection of the first sensor detectable indicia, reversing the motive force to move the charge retentive surface in the first direction.

To control the operation of the back tracking function, to remove the uncertainty of the amount of slip, at least first and second sensor detectable indicia are provided on the charge retentive member spaced therealong at an interval equivalent to the desired back tracking distance. Thus, back tracking may be enabled upon the detection of one of the sensor detectable indicia, causing the drive member to drive the charge retentive member in a reverse direction until a second detectable indicia is detected.

In accordance with still another aspect of the invention, belt velocity variations due to the uncertainty of the amount of slip, may be compensated with a feedback provision that uses the described sensor/indicia arrangement to detect average belt velocity.

These and other aspects of the invention will become apparent from the following description used to illustrate a preferred embodiment of the invention read in conjunction with the accompanying drawings in which.

Figure 1:
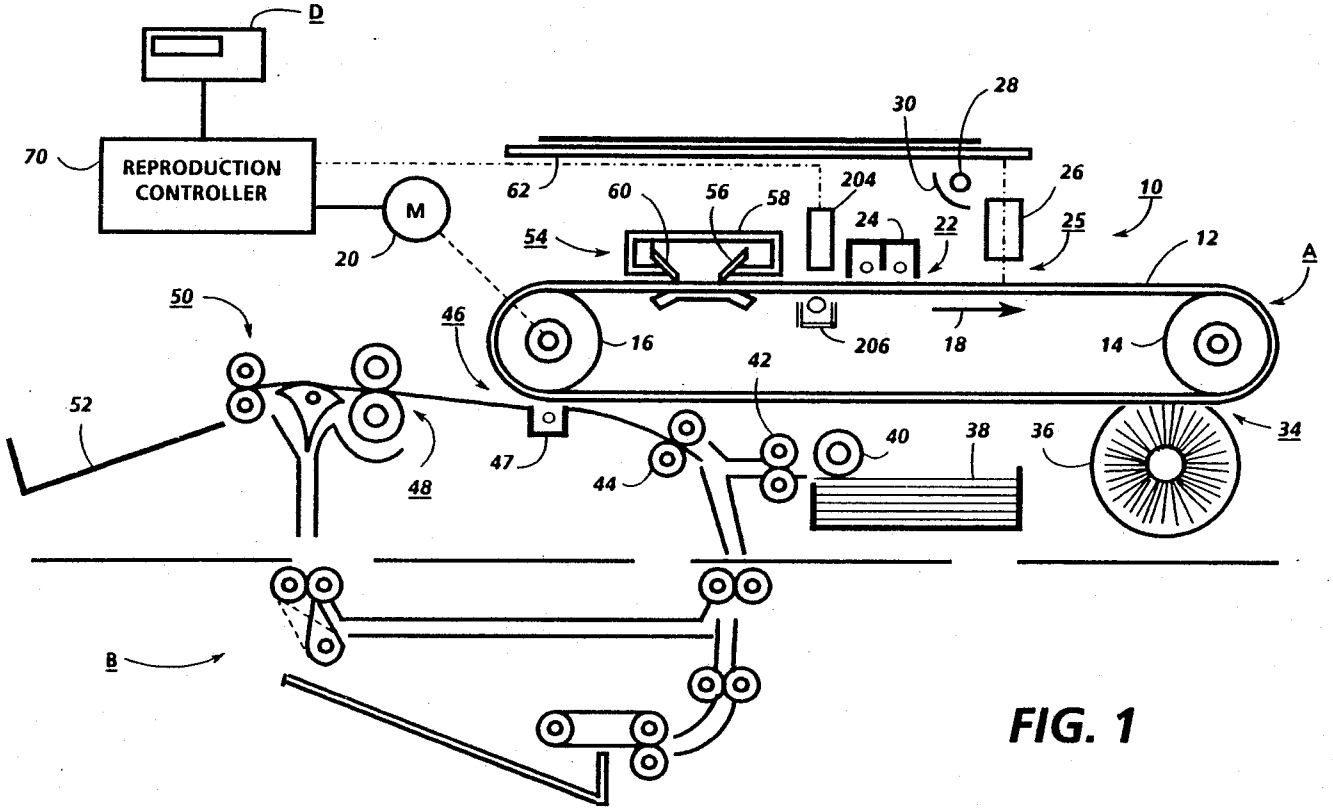
FIG. 1 is a schematic elevational view depicting an electrophotographic printing machine incorporating the present invention.

Referring now to the drawings where the showings are for the purpose of describing a preferred embodiment of the invention and not for the purpose of limiting same. FIG. 1 shows a reproduction machine in accordance with the invention, and including a somewhat schematic view of a copy sheet path as it carries paper through the processing stations of a reproduction machine.

The reproduction processor A illustrated in FIG. 1 employs a flexible belt-type photoreceptor member 10, the outer surface 12 of which is coated with a suitable photoconductive material for electrophotographic copying. The belt is suitably mounted for revolution within the processor about driven transport rolls 14 and 16, and travels in the direction indicated by the arrows numbered 18 on the inner run of the belt to bring the photoreceptor surface 12 thereon past a plurality of conventional xerographic processing stations. Suitable drive means such as motor 20 are provided to power and coordinate the motion of the various cooperating machine components whereby a faithful reproduction of the original input image information is recorded upon a copy sheet, such as a paper or the like.

Initially, photoreceptor 10 is passed through a charging station 22 wherein photoreceptor surface 12 is uniformly charged with an electrostatic charge placed on the photoreceptor surface by charge corotron 24 in a known manner preparatory to imaging. Thereafter, at exposure station 25, photoreceptor surface 12 is exposed to light reflected from a document placed on the platen whereby the charge placed on photoreceptor surface is selectively dissipated in the exposed regions to record the document image in the form of electrostatic latent image. The exposure station 25 may comprise a bundle of image transmitting fiber lenses 26 produced under the trade namer of "SELFOC" by Nippon Sheet Glass Company Limited, together with an illuminating lamp 28 and a reflector 30 which illuminate and direct light from the document to the photoreceptor surface. Together the charging station and the exposure station form the latent image required for imaging.

Subsequent to the creation of the latent image, photoreceptor surface 12 is moved through development station 34. A suitable development station could include a magnetic brush development system, including developer roll 36, utilizing a magnetizable developer mix having coarse magnetic carrier granules and toner colorant particles. The operator may be provided with means to select among a choice of colored toners to apply images onto copy sheets in different colors.

Blank copy sheets are supported in a stacked arrangement on blank copy sheet stack support tray 38. Sheet separator segmented feed roll 40 feeds individual copy sheets therefrom through pinch roll nip 42 to the registration pinch roll nip 44. The copy sheets are forwarded to a transfer station 46 in proper registration with the image on photoreceptor surface 12. The developer toner image on photoreceptor surface 12 is brought into contact with the copy sheet within transfer station 46. The toner image is transferred from photoreceptor surface 12 to the contacting side of the copy sheet by means of transfer corotron 47. Following transfer of the image, the copy sheet is separated from photoreceptor surface 12 by the beam strength of copy sheet as it passes around the curved face of photoreceptor member 10 around the transport roller 16. The copy sheet supporting the toner image thereon is advanced through fusing station 48 wherein the toner image is permanently affixed to the copy sheet at heat and pressure roll nip 49. After fusing, the copy sheet is advanced to a reversible exit nip 50 where the sheet may be directed to an output such as sheet stacking tray 52 or a sorter, or directed to the duplex portion of the machine, such as duplex module B for return to the copy sheet registration pinch roll nip 44 for second side copying. Reversible exit nip 50 is controllably driven in forward, reverse, or stop motion to selectably direct copy sheets in the direction required by the machine operation.

Although a preponderance of toner on photoreceptor surface 12 is transferred to the copy sheet, invariably some residual toner remains on the photoreceptor surface after the transfer of the toner image to the copy sheet. Residual toner particles are removed from photoreceptor surface 12 at cleaning station 54 which comprises a cleaning blade 56 in scraping contact with photoreceptor surface 12, and contained within cleaning housing 58, which acts as a sump with cleaning seal 60 associated with the upstream opening of the cleaning housing.

When the copier is operated in the conventional mode, an original document to be reproduced is placed on platen 62 which is scanned past exposure station 25 for the creation of a latent image on the photoreceptor surface. Movement of photoreceptor 10 and platen 62 are synchronized to provide for accurate reproduction of the document. Alternatively, a multi-mirror scanning optics arrangement may be substituted for the fiber optic lens, in which a mirror arrangement is scanned past a stationary document, to direct light from a document to photoreceptor surface 12. An automatic document feeder (not shown) may be provided to feed documents into position on the platen 62. A similar function is also accomplished by an electronic printer employing a laser driven in accordance with an electronic image stored in memory to selectively dissipate charge from the photoreceptor surface, or in an ionographic printer employing an modulated stream of ions to form the image on a charge retentive substrate.

Reproduction machine controller 70 is preferably a known programmable controller or combination of controllers, which conventionally controls all of the machine steps and functions described herein and including the operation of the belt drivers, paper path drives in both the reproduction processor A and duplex module B. As further described herein, controller 70 also conventionally provides for storage and comparisons of counted values including copy sheets and documents, and numbers of desired copies, and control and execution of operations selected by an operator through operator display and control D. Controller 70 may be responsive to a variety of sensing devices such as paper size sensors, edge sensors, etc., to further enhance its control of the reproduction machine. A machine control panel (not shown) may be provided to enter operational commands or instructions to controller 70.

Figure 2:
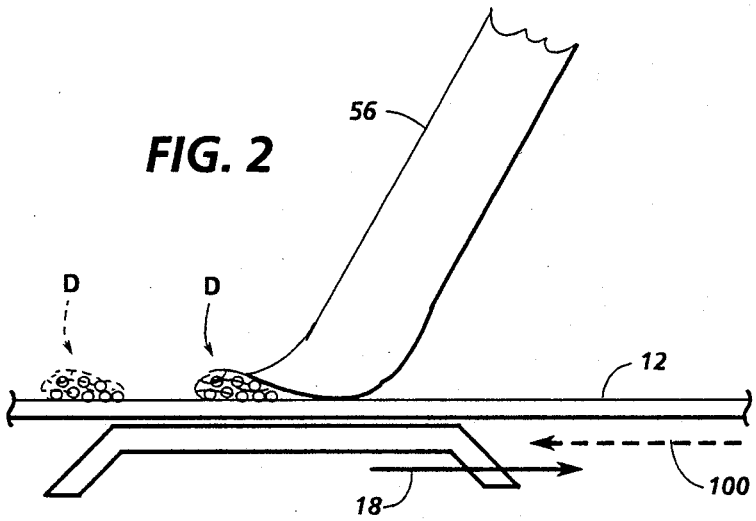
FIG. 2 shows a schematic elevational view depicting a cleaning station in the usual configuration.

FIG. 2 shows an enlarged schematic sectional view of the cleaning station 54 of FIG. 1, including cleaning blade 56, which, in a preferred embodiment, is arranged in cleaning relationship with belt 12 for the chiseling removal of residual toner and debris remaining on belt 12 subsequent to the imaging process. Toner and debris (referred to hereinafter as debris, and indicated in FIG. 2 generally as D) accumulate between the blade 56 and belt 10, eventually causing a copy quality defect characterized by streaking on copies. Periodically, or perhaps in response to a user command, the reproduction controller 70 runs the back tracking program to clear debris from the cleaning blade and instructs motor 20 to drive driven transport rolls 14 and 16 in the reverse direction from the usual process direction, so that the belt is driven in direction 100. In such case, the debris is released from between blade 56 and belt 10, and is transported away with the rest of the waste toner for retention in the sump.

Figure 3:
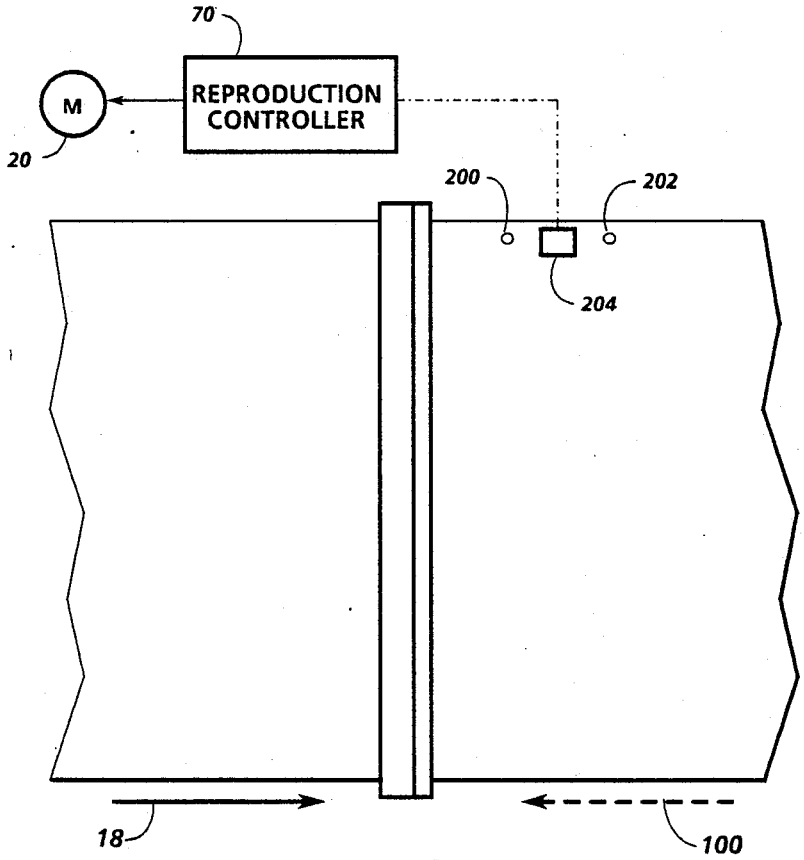
FIG. 3 is a schematic top view of the cleaning station.

In accordance with the invention and as shown in FIG. 3, a top schematic sectional view of the cleaning station 54 shows the arrangement of the blade 56 across the photoreceptor, transverse to the direction of photoreceptor movement. A pair of sensor detectable indicia 200 and 202 is provided along the photoreceptor, adjacent to an edge thereof, which in one embodiment are holes through the photoreceptor. The indicia are spaced along the belt surface 12 at an interval selected to provide an optimum back tracking clearance function, 0.5" to 0.75", depending on the size of the toner retaining cleaning housing or sump. As best shown in FIG. 1, a detector 204 and illuminator 206 are provided to illuminate the hole and allow detection thereof. Upon detection of the holes, detector 200 provides an appropriate detection signal to the reproduction controller to control the direction of belt motion. It will no doubt be appreciated that at least one of the holes, detector 204 and illuminator 206 are commonly provided for control of the imaging operation in accordance with detected belt position. Of course, a variety of sensor detectable indicia may be alternatively provided, including notches in the edge of the belt, markings on either side of the photoreceptor belt, or a continuous indicia over the back tracking interval where start and completion of detection mark the first and second sensor detectable indicia. Sensors adapted to detection of the particular indicia arrangement may also be used.

Figure 4:
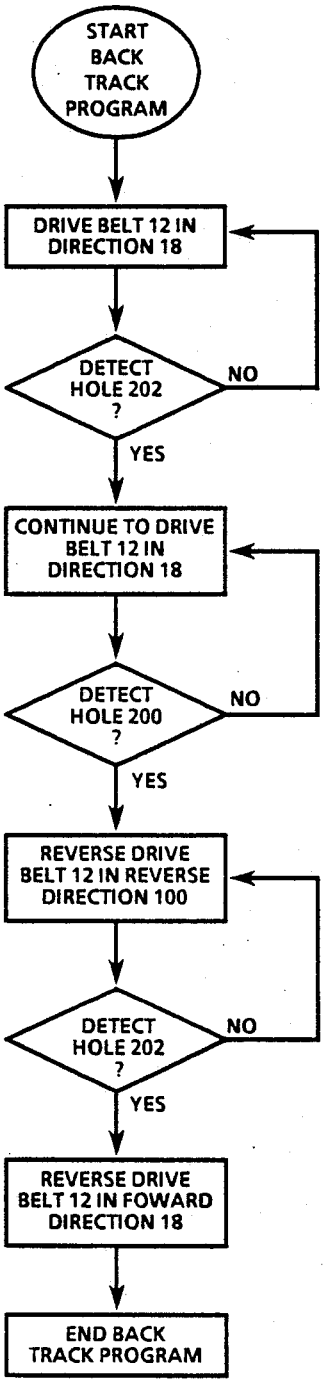
FIG. 4 shows a flow chart describing the operation of the back tracking arrangement.

With reference now to FIG. 4, a flow chart outlining the basic back tracking operation is provided. Upon entering the back tracking program, belt 12 is driven in direction 18 by motor 20 driving transport rolls 14 and 16. Belt 12 is driven until both holes 202 an 200 are detected, whereupon motor 20 is instructed to reverse driven driven transport rolls 14 and 16 to drive belt 12 in the opposite direction 100. Upon subsequent detection of hole 202, the motor is again instructed to reverse drive driven transport rolls 14 and 16 to drive belt 12 in the opposite direction, to commence normal operation of the machine.

Figure 5:
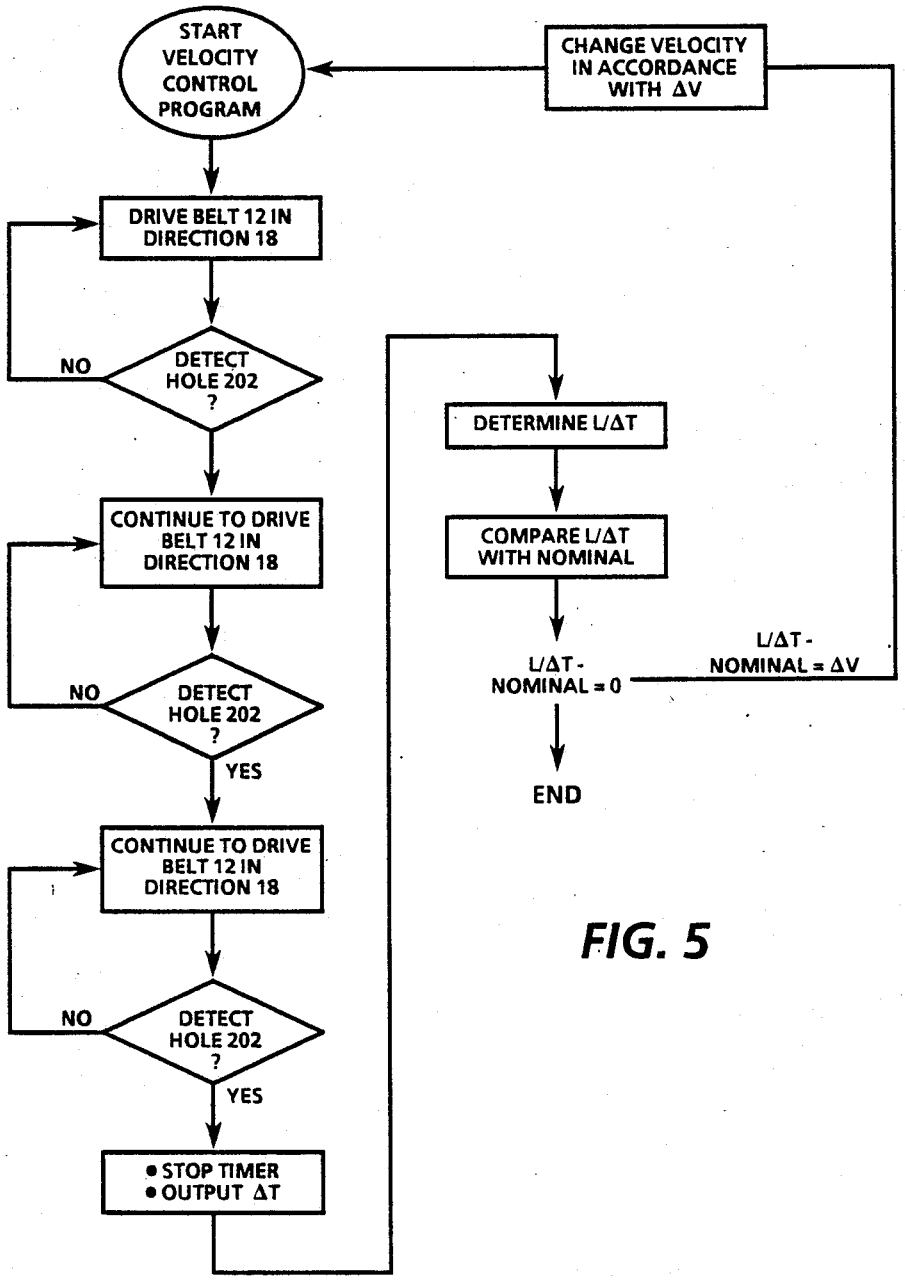
FIG. 5 shows a flow chart describing the correction of the average velocity of the belt.

In accordance with another aspect of the invention, and as shown in the flow chart of FIG. 5, average velocity of the belt may be sensed and adjusted by the same arrangement as described for control of the back tracking distance. Because the belt length is a known value L, and because the sensors are positioned to detect passage of the belt in each revolution, the average velocity of the belt may be determined by timing the period $\Delta T$ for a belt revolution, as detected by the sensors detecting one of the indicia two times. Velocity measurement may be accomplished by measuring the period $\Delta T$, or counting machine counts, in a standard manner.

The same unpredictable factor of the frictional engagement of the drive rolls and belt 12 occurs during standard forward motion of the belt. Controller 70 can easily determine average velocity by determining the known belt length d divided by the revolution period $\Delta T$. However $\Delta T$ is measured, in time or machine counts, a comparison may be made of the derived value with a nominal value to determine the deviation in belt's nominally expected velocity. Motor speed may be adjusted accordingly, or an indication may be made that service is required.

The invention has been described with reference to a preferred embodiment. Obviously modifications will occur to others upon reading and understanding the specification taken together with the drawings. This embodiment is but one example, and various alternatives, modifications, variations or improvements may be made by those skilled in the art from this teaching which are intended to be encompassed by the following claims.

I claim:

1. In an imaging device having a belt-type member with a charge retentive surface moved along an endless path past a plurality of processing stations with a frictionally engaging drive arrangement; a motor coupled to the drive arrangement providing a motive force to move the charge retentive surface along the endless path in either of forward and reverse directions; a latent image forming station; a developing station developing the latent image with toner; a transfer station for transferring the developed latent image to a substrate; and a cleaning station including a cleaning blade for releasing residual toner and debris from the charge retentive surface after transfer, and a back tracking arrangement for releasing toner and debris entrapped between the cleaning blade and the charge retentive surface including:

a controller for selectively controlling the motor to move the charge retentive surface along either of forward and reverse directions along the endless path;

at least first and second sensor detectable indicia on the charge retentive surface, spaced at an interval therealong equivalent to a desired back tracking device; and a sensor arrangement located at a fixed position relative to the moving charge retentive surface for detecting the passing of each indicia thereby, and producing a signal indicative thereof to the controller.

2. The device as defined in claim 1 wherein the sensor detectable indicia are apertures defined through the charge retentive surface.

3. The device as defined in claim 2 wherein the sensor arrangement includes a photosensitive device and a light source, the light source arranged to direct light towards and through the aperture for detection by the photosensitive device when the aperture passes the fixed position.

4. A method of controlling a back tracking function in an imaging device having a belt-type member with a charge retentive surface moving along an endless path past a plurality of processing stations with a frictionally, engaging drive arrangement; a motor coupled to the drive arrangement providing a motive force to move the charge retentive surface along the endless path in either of forward and reverse directions, a latent image forming station; a developing station developing the latent image with toner; a transfer station for transferring the developed latent image to a substrate; and a cleaning station including a cleaning blade for releasing residual toner and debris from the charge retentive surface after transfer; the back tracking function operative to release toner and debris entrapped between the the cleaning blade and the charge retentive surface including the steps of:

providing at least first and second sensor detectable indicia on the charge retentive surface, spaced at a selected interval, and a complementary sensor arrangement at a fixed location with respect to the endless path to detect the indicia as they pass thereby;

moving the charge retentive surface along the endless path in a first direction;

detecting the passage the first and second sensor detectable indicia on the charge retentive surface;

upon detection of the second sensor detectable indicia, reversing the motive force provided to the drive arrangement to move the charge retentive surface in a second direction, opposite said first direction;

detecting the first sensor detectable indicia;

upon detection of the first sensor detectable indicia, reversing the motive force to move the charge retentive surface in the first direction.

5. In an imaging device having a belt-type member with a charge retentive surface moved along an endless path past a plurality of processing stations with a frictionally engaging drive arrangement; a motor coupled to the drive arrangement providing a motive force to move the charge retentive surface along the endless path in either of forward and reverse directions; a latent image forming station; a developing station developing the latent image with toner; a transfer station for transferring the developed latent image to a substrate; and a cleaning station including a cleaning blade for releasing residual toner and debris from the charge retentive surface after transfer, and a back tracking arrangement for releasing toner and debris entrapped between the cleaning blade and the charge retentive surface including:

control means for selectively controlling the movement of the charge retentive surface;

at least a first and second sensor detectable indicia on the charge retentive surface, spaced at a selected interval therealong indicating a limit of the back tracking distance; and sensing means located at a fixed position relative to the moving charge retentive surface for detecting the passing of each indicia thereby, and producing a signal indicative thereof to the control means.

6. The device as defined in claim 5 wherein the sensor detectable indicia are apertures defined through the charge retentive surface.

7. The device as defined in claim 2 wherein the sensor arrangement includes an illumination sensitive device and an illumination source arranged to direct light towards and through the aperture when the aperture passes the fixed position.

8. In an imaging device having a belt-type member, with a charge retentive surface and a predetermined length, moved along an endless path past a plurality of processing stations with a frictionally engaging drive arrangement; a motor coupled to the drive arrangement providing a motive force to move the charge retentive surface along the endless path; a latent image forming station; a developing station developing the latent image with toner; a transfer station for transferring the developed latent image to a substrate; a cleaning station and a belttype member velocity control arrangement including:

control means for selectively controlling the operation of the motor;

at least a first detectable indicia on the charge retentive surface;

sensing means located at a fixed position relative to the moving charge retentive surface for detecting the passing of said indicia thereby, and producing a signal indicative thereof to the control means;

means for measuring a time interval between successive detections of said indicia;

and means for comparing the time interval between successive detections of said indicia with a nominal value for determination of velocity error; and said control means producing a response based on said velocity error.

9. The device as defined in claim 8 wherein the sensor detectable indicia are apertures defined through the charge retentive surface.

10. The device as defined in claim 8 wherein the response of the control means varies the operation of the motor.

11. The device as defined in claim 8 wherein the response of the control means produces a response indicative of a service requirement.

12. In an imaging device having a belt-type member, with a charge retentive surface and a predetermined length, moved along an endless path past a plurality of processing stations with a frictionally engaging drive arrangement; a motor coupled to the drive arrangement providing a motive force to move the charge retentive surface along the endless path in either of forward and reverse directions; a latent image forming station; a developing station developing the latent image with toner; a transfer station for transferring the developed latent image to a substrate; and a cleaning station including a cleaning blade for releasing residual toner and debris from the charge retentive surface after transfer, and a dual purpose sensor arrangement for sensing distance of movement of the belt-type member, for control of a back tracking arrangement for releasing toner and debris entrapped between the cleaning blade and the charge retentive surface, and for velocity control including:

control means for selectively controlling the movement of the charge retentive surface;

at least a first and second sensor detectable indicia on the charge retentive surface, spaced at a selected interval therealong indicating a limit of the back tracking distance; and sensing means located at a fixed position relative to the moving charge retentive surface for detecting the passing of each indicia thereby, and producing a signal indicative thereof to the control means;

said sensing means operative for a first purpose for sensing the limit of the backtracking distance during a back tracking function; and said sensing means operative for a second purpose for sensing the completion of a passage of the belt-type member through the endless path during a measurement of velocity of the belt-type member.

* * * * *